US010258171B2

(12) United States Patent
Le

(10) Patent No.: US 10,258,171 B2
(45) Date of Patent: Apr. 16, 2019

(54) MODULAR APPARATUS AND SYSTEM FOR ACCOMMODATING AND DISPENSING CANS AND A METHOD FOR FORMING THE SAME

(71) Applicant: Cambro Manufacturing Company, Huntington Beach, CA (US)

(72) Inventor: Johannes Le, Huntington Beach, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 115 days.

(21) Appl. No.: 15/359,376

(22) Filed: Nov. 22, 2016

(65) Prior Publication Data

US 2018/0140112 A1 May 24, 2018

(51) Int. Cl.

| | |
|---|---|
| ***A47F 5/10*** | (2006.01) |
| ***A47F 5/00*** | (2006.01) |
| ***A47F 7/28*** | (2006.01) |
| ***A47F 1/08*** | (2006.01) |

(52) U.S. Cl.

CPC ..... *A47F 5/108* (2013.01); *A47F 1/087* (2013.01); *A47F 5/0025* (2013.01); *A47F 7/28* (2013.01)

(58) Field of Classification Search

CPC ..... A47F 5/0025; A47F 5/108; A47F 1/087; A47F 1/08; A47F 1/12; A47F 1/04; A47F 7/28; G07F 11/30

See application file for complete search history.

(56) References Cited

U.S. PATENT DOCUMENTS

| | | | | | |
|---|---|---|---|---|---|
| 2,888,145 | A * | 5/1959 | Knott | A47F 1/087 | 211/59.2 |
| 3,784,022 | A * | 1/1974 | Beesley, Jr. | A47B 87/005 | 193/27 |
| 4,105,126 | A * | 8/1978 | Deffner | A47F 1/12 | 211/59.2 |
| 4,228,903 | A * | 10/1980 | Eckert | A47F 1/12 | 193/2 D |
| 4,356,923 | A * | 11/1982 | Young | A47F 7/28 | 211/184 |
| 4,474,297 | A * | 10/1984 | Zucker | A47F 1/12 | 211/184 |
| 4,744,489 | A * | 5/1988 | Binder | A47F 1/087 | 211/128.1 |
| 4,911,309 | A * | 3/1990 | Stefan | A47F 1/087 | 211/189 |
| 5,356,033 | A * | 10/1994 | Delaney | G07F 11/34 | 221/150 R |

(Continued)

*Primary Examiner* — Patrick D Hawn

(74) *Attorney, Agent, or Firm* — Marcus C. Dawes; George Bethel

(57) ABSTRACT

An apparatus and system for dispensing large amounts of cylindrical food containers or cans. The apparatus includes at least two support frames joined together through a series of connector pieces. Additional support frames may be added to the apparatus to create a modular system of dispensers that are customizable according to user discretion. The apparatus and system may be disposed directly on the traverses of a shelving unit so that large number of can dispensers may be accommodated within a relatively small volume or storage space. Each can dispenser may accommodate multiple cans which are orientated so that as each can is removed from the dispenser, a subsequent can will roll forward and take its place.

14 Claims, 11 Drawing Sheets

(56) References Cited

U.S. PATENT DOCUMENTS 5,462,198 A * 10/1995 Schwimmer ..... G07F 11/34 221/130
6,991,116 B2 * 1/2006 Johnson ..... A47F 1/087 211/59.2
7,207,447 B2 * 4/2007 Medcalf ..... A47F 1/087 211/59.2
7,850,015 B1 * 12/2010 Mason ..... A47F 5/0043 211/175
7,913,860 B2 * 3/2011 Merl ..... G07F 11/16 211/59.2
7,918,365 B2 * 4/2011 White ..... A47F 1/087 221/123
7,922,437 B1 * 4/2011 Loftin ..... A47F 1/087 229/122.2
7,997,427 B2 * 8/2011 Lowenbraun ..... A47F 1/12 211/59.2
8,308,023 B2 * 11/2012 Gelardi ..... A47F 1/087 221/31
8,322,543 B2 * 12/2012 Gelardi ..... A47F 1/087 211/59.2
8,448,815 B2 * 5/2013 Sholl ..... A47F 1/08 221/15
8,827,111 B2 * 9/2014 Johnson ..... A47F 1/087 221/124
2004/0011751 A1 * 1/2004 Johnson ..... A47F 1/087 211/59.2
2005/0127015 A1 * 6/2005 Medcalf ..... A47F 1/087 211/59.2
2006/0278591 A1 * 12/2006 Tippets ..... A47F 1/087 211/59.2
2007/0289990 A1 * 12/2007 Artsiely ..... G07F 11/30 221/251
2008/0245813 A1 * 10/2008 Johnson ..... A47F 1/087 221/194
2009/0212066 A1 * 8/2009 Bauer ..... A47F 1/087 221/281
2009/0266776 A1 * 10/2009 Johnson ..... A47F 1/04 211/59.2
2009/0308885 A1 * 12/2009 Sainato ..... G07F 11/30 221/194
2010/0032391 A1 * 2/2010 Schneider ..... A47F 1/087 211/59.2
2010/0096401 A1 * 4/2010 Sainato ..... G07F 11/30 221/8
2011/0121011 A1 * 5/2011 Gelardi ..... A47F 1/08 221/30
2011/0121022 A1 * 5/2011 Sholl ..... A47F 1/08 222/23
2012/0018391 A1 * 1/2012 Gelardi ..... A47F 1/087 211/59.2
2012/0211522 A1 * 8/2012 Gelardi ..... A47F 1/087 222/173
2012/0217261 A1 * 8/2012 Bailey ..... A47F 1/087 221/282
2012/0285976 A1 * 11/2012 Bogdziewicz, III .... A47F 1/087 221/1

* cited by examiner

MODULAR APPARATUS AND SYSTEM FOR ACCOMMODATING AND DISPENSING CANS AND A METHOD FOR FORMING THE SAME

BACKGROUND

Field of the Technology

The invention relates to the field of industrial food stuff storage, specifically to a modular apparatus and system which may formed to accommodate and dispense large cans on a modular shelf.

Description of the Prior Art

Large food item containers such as #5 or #10 sized aluminum cans have long been used to store food stuffs in warehouses, food retailers, and the like. Due to their relative large size and volume however, having a number of these food item containers in the same location will quickly use up any available shelf space when the food item containers are stored in the traditional fashion, namely with the containers stored upright or even stacked on top of one another.

Several attempts have been made previously which aim to solve the problem of maximizing storage space when storing or accommodating large cylindrical cans. Most prior art attempts comprise a gravity-fed rack or organizer which accommodate a plurality of cans, notably smaller aluminum cans used for beverages or smaller quantities of canned food stuffs. The cans are loaded lengthwise or sideways on to a top rack which is inclined downwards toward a bottom rack which is in turn inclined downwards in the opposing direction towards the front of the organizer. When a user removes a can from the front of the organizer, the remaining cans disposed in the organizer all roll forward at their respective positions, with cans disposed in the top rack falling down into the bottom rack as space dictates. Because the top and bottom racks are disposed at an incline relative to the surface on which the organizer rests, this ensures that the next can rolls towards the front portion of the organizer, even when the next can is the only remaining can left.

Other can dispensers are simple vertical racks which hold a plurality of cans that are orientated sideways or lengthwise within the dispenser. The dispenser comprises an opening at the bottom which is sized to fit only one can there at time so that when a user removes the can disposed within the opening, the next can disposed directly above drops down into the removed can's space.

Despite the specific orientations or configurations of previous can dispensers found in the art, each dispenser functions as a standalone unit. Specifically, each dispenser is a discrete structural unit that does not share any components with that of any other dispenser unit. Additionally, because most can dispensers are to be used in a majority of locations, many can dispensers comprise a universal shape or design without any accommodation for what type of shelf or storage unit the can dispenser is disposed upon. The result therefore is that when multiple can dispensers are to be stored in a single location, for example on a shelving unit or bookcase, the user must orient or slide the can dispensers next to each other or as close as possible so as to place all the dispensers within the shelving unit. This can lead to an inefficient use of storage space as well as fail to take advantage of the structural strength of the shelving unit itself, thus leading to a possible structural failure of the shelving unit or can dispensers.

What is needed is a can dispenser and a system of can dispensers which can be linked together so as to encompass all the area available within a given storage space such as a shelving unit and the like. What is also needed is a can dispenser and a system of can dispensers which are capable of being coupled directly to the structural frame of a storage unit so that a maximum amount of support for the can dispensers and the cans contained therein can be obtained.

BRIEF SUMMARY

The current invention provides an apparatus for accommodating and dispensing a plurality of cans. The apparatus may be known as a can dispenser and includes a first support frame, a second support frame that is disposed substantially angular or parallel to the first support frame, and multiple connectors which are removably connected via a connecting means to the first support frame and the second support frame. Each of the connectors are substantially angular and/or perpendicularly oriented between the first and second support frames. The first support frame and the second support frame each include an upper ramp, rail, or guide and a lower ramp, rail, or guide.

In one embodiment, the first support frame and second support frame each have multiple shelf supports which are configured to rest on a pair of parallel or substantially horizontal traverses of a shelf unit.

In another embodiment, the connectors of the apparatus are removably connected via a connection means to both the first support frame and the second support frame by means of a corresponding number of connection points that are disposed on the first support frame and the second support frame. In one preferred embodiment, the connection means comprise a frictional engagement. Each of the plurality of connection points on the first and second support frames include a protrusion. The protrusion of each of the plurality of connection points also has an upper recess and a lower recess defined in its surface.

In another embodiment, each of the connectors used to couple the first and second support frames together includes a body or link with a coupling portion disposed at either end. Each coupling portion has a reduced cross sectional thickness relative to the remaining body portion of the connector. The coupling portion of each connector further includes a protrusion slot defined therein which in turn accommodates a bifurcated fork element.

In yet another embodiment, the lower ramp, guide, or rail of the first support frame and the second support frame have at least one portion that is oriented at an incline relative to the rest of the lower ramp.

In yet another embodiment, the first support frame and the second support frame of the can dispenser each comprise a stop coupled to each respective lower ramp of the first support frame and second support frame.

In still a further embodiment, both the upper ramp and the lower ramp of each of the first and second support frames have a dual sided flange which extends substantially outward from each lateral side of the first and second support frames.

In yet another embodiment, the first and second support frames each contain multiple shelf supports that are each configured to be placed on or about a pair of substantially parallel and vertically disposed traverses of a shelf unit.

The current invention further includes a system for accommodating and dispensing a plurality of cans in a side by side serialized relationship. The system includes multiple support frames or panels and multiple connectors or links, each of the connectors being removably coupled via a connection means to at least two support frames. Each of the connectors that are preferably removably coupled via a connection means to at least two of the support frames are perpendicularly or angularly oriented relative to the support frame it is coupled to. In one preferred embodiment, the connection means comprises a frictional engagement. Additionally, each of the support frames within the system have at least two shelf supports which are configured to be placed on or about a pair of substantially parallel and horizontally disposed traverses of a shelf unit.

In one embodiment, each of the connectors that are removably coupled through a frictional engagement to at least two of the support frames are coupled to one of a number of connection points present on each of the support frames. Each of the connection points have a protrusion with an upper recess and a lower recess defined in its surface.

In another embodiment, the support frames of the system each include an upper and a lower ramp, rail, or guide. The lower ramp has at least one portion that is oriented at an incline relative to a remaining portion of the lower ramp. The upper ramp and the lower ramp of each of the support frames each have a dual sided flange which extends substantially outward from each lateral side of each of the support frames.

Finally, the current invention also includes a method for forming a can dispenser of variable size within a shelf unit. The method includes coupling one end of each of a first group of connectors to a first support frame at a position that is at an angle relative to the first support frame through a connection means and then coupling the opposing end of each of the first group of connectors to a second support frame at a position that is at an angle relative to the second support frame. The first support frame and the second support frame are then placed on or about a pair of substantially horizontal traverses of the shelf unit. Preferably, the connection means used to couple the first and second support frames together comprises a frictional engagement.

In one embodiment, wherein coupling an end of each of a plurality of connectors to a first support frame and coupling an opposing end of each of the plurality of connectors to a second support frame includes frictionally engaging both the end and the opposing end of each of the plurality connectors at a position that is substantially perpendicular to the first support frame and the second support frame, respectively.

In another embodiment, frictionally engaging one end of the first group of connectors to the first support frame and the other end of the first group of connectors to the second support frame comprises frictionally engaging each of the first group of connectors to at least one connection point present on the first support frame and the second support frame, respectively. Each of the first group of connectors is coupled to a respective connection point by inserting a protrusion that is present on the connection point into a coupling portion placed at both ends of each of the connectors. Specifically, each protrusion is inserted into each coupling portion by inserting at least one of two recesses defined in the protrusion into a protrusion slot defined in each coupling portion, and more specifically into a bifurcated fork element located within the coupling portion.

In one specific embodiment, the remaining open recess not coupled to one of the connectors of the first group is inserted into the coupling portion of one of a second group of connectors.

In another embodiment, the method further includes frictionally engaging one end of each of a second group of connectors to either the first support frame or the second support frame and then removably coupling the other end of each of the second group of connectors to a third or subsequent support frame. The subsequent support frame is then placed on or about the substantially horizontal traverses of the shelf unit next to the first and second support frames.

In one embodiment, frictionally engaging one end of the second group of connectors to either the first support frame or second support frame and the other end of the second group of connectors to the subsequent support frame preferably includes frictionally engaging each of the second group of connectors to at least one connection point present on either the first support frame or second support frame and to the subsequent support frame, respectively. Each of the second group of connectors are connected to each connection point located on either the first support frame or second support frame and to the subsequent support frame by inserting a protrusion disposed on each of the connection points into a coupling portion located on either end of each of the second group of connectors. Specifically, inserting the protrusion into the coupling portion located on either end of each of the second group of connectors includes inserting at least one of two recesses defined in the protrusion into a protrusion slot within in each coupling portion, and more specifically into a bifurcated fork element within the protrusion slot.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
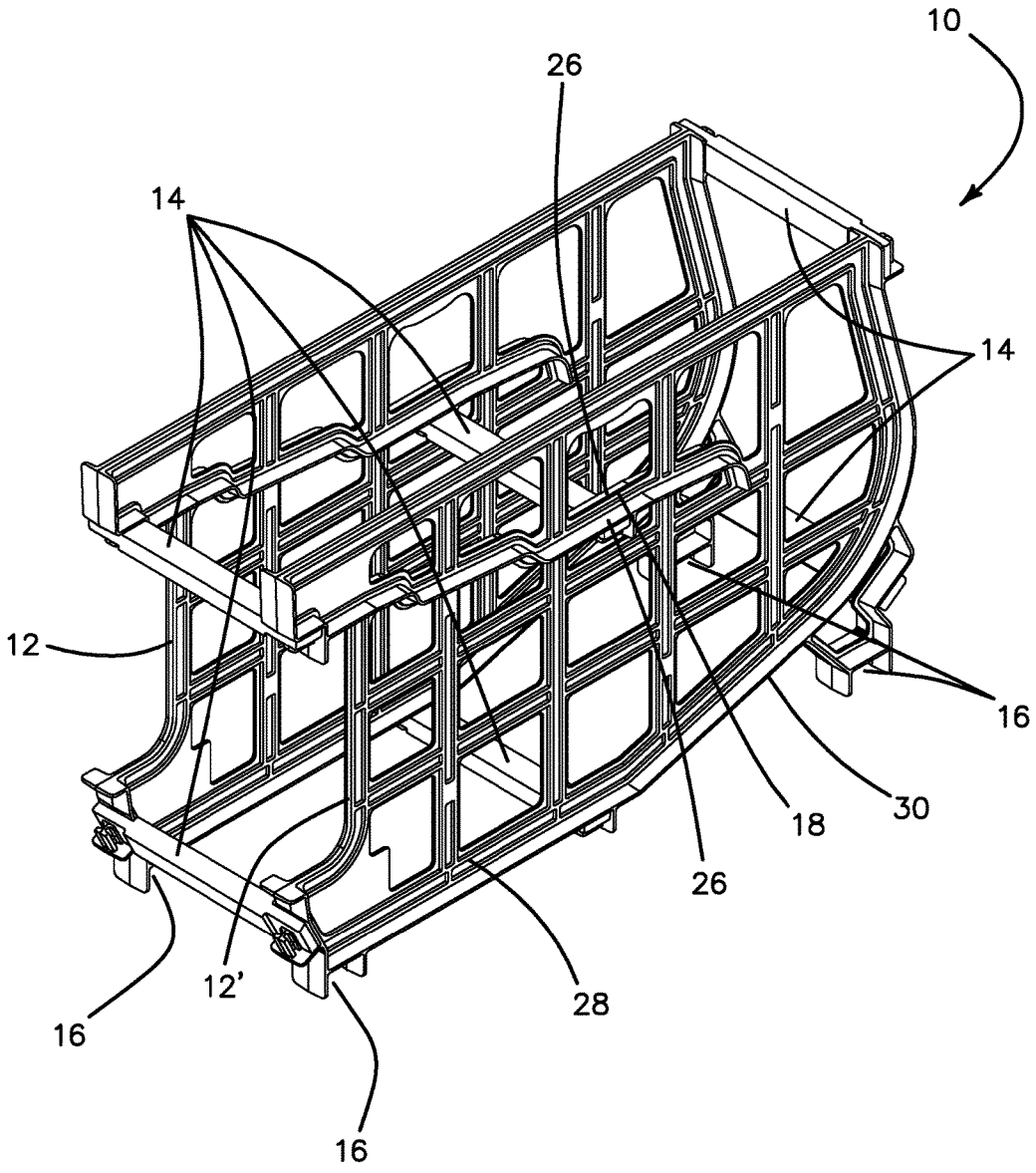
FIG. 1 is a perspective view of a can dispenser of the current invention.

The current invention is a can dispenser which is shown in FIG. 1 and is generally denoted by reference numeral 10. The can dispenser 10 comprises two basic structural elements, specifically a face, panel, or support frame 12 and a cross piece, link, or connector 14. As seen in FIG. 1, each can dispenser 10 comprises at least two faces of panels, trusses, or support frames 12 with a plurality of links, struts, or connectors 14 disposed there between, hereinafter referred to as a support frame 12. FIG. 1 specifically shows two support frames 12 in a vertical or upright position with at least six connectors 14 or links disposed in a substantially horizontal position and coupled to each of the support frames 12 at their respective ends. It is to be expressly understood however that fewer or additional components other than what is explicitly shown may also be used without departing from the original spirit and scope of the invention. Additionally, both the support frames 12 and the connectors 14 are preferably comprised of injection molded plastic, however other equivalent materials and methods of manufacture now known or later devised may also be used without departing from the original scope of the invention.

Figure 2:
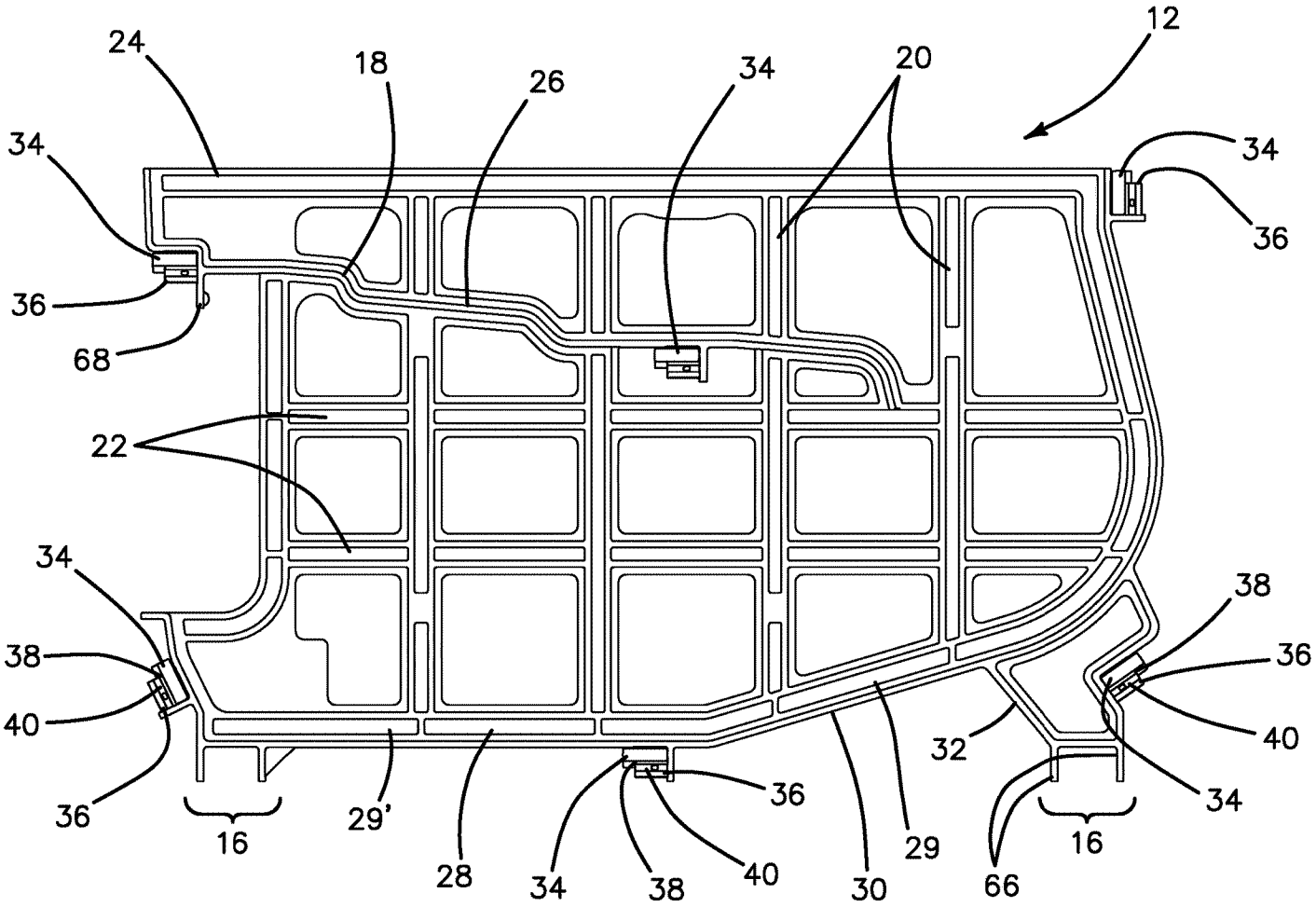
FIG. 2 is a side elevation view of a support frame component used to form the can dispenser seen in FIG. 1.

Greater detail of the support frames 12 may be seen in FIG. 2. The frame 12 comprises a truss-like structure comprising a plurality of vertical supports, columns, or struts 20 and a plurality of horizontal traverses or beams 22 in a substantially crisscross or interlocking pattern as seen in FIG. 2. Disposed across a subset of the plurality of vertical struts 20 is a dual sided upper ramp, rail, or guide 18. The upper ramp 18 begins substantially near a top portion 24 of the frame 12 and is oriented or angled downwardly towards a center portion of the frame 12 through a series of "steps" or graduated levels connected together by a downwardly sloping portion. The upper ramp or rail 18 is double sided and comprises an extension or flange 26 that extends outwardly perpendicularly from either lateral side of the frame 12 as best seen in FIG. 1. The frame 12 further comprises a lower ramp or rail 28 which like the upper ramp or rail 18, comprises a dual sided extension or flange 30 which extend outwards perpendicularly from either lateral side of the frame 12. The lower ramp or rail 28 comprises a substantially angled or inclined portion 29 and a substantially planar or flat portion 29'. Coupled underneath the lower ramp or rail 28 is at least two lower support shelf traverse apertures, supports, or feet, hereinafter referred to as lower shelf supports 16. As best seen in FIG. 2, each of the lower shelf support 16 is comprised of a substantially U-shaped protrusion with a set of parallel forked elements or shelf brackets 66 extending downwardly from the lower ramp or rail 28. At least one of the lower shelf support 16 is disposed directly beneath the lower ramp or rail 28, while at least one other lower shelf support 16 is coupled to a frame extension or support structure 32 so that the at least two lower shelf supports 16 are disposed at the same vertical position relative to each other. Each support structure 12 further comprises a plurality of connection points 34 disposed at a variety of positions related to the support structure 12 as seen in FIG. 2. Each connection point 34 in turn comprises a cylindrical protrusion 36 with a plurality of substantially hemispherical recesses defined therein, namely an upper recess 38 defined at a distal end of the protrusion 36 and a lower recess 40 defined at a proximal end of the protrusion 36.

Figure 5:
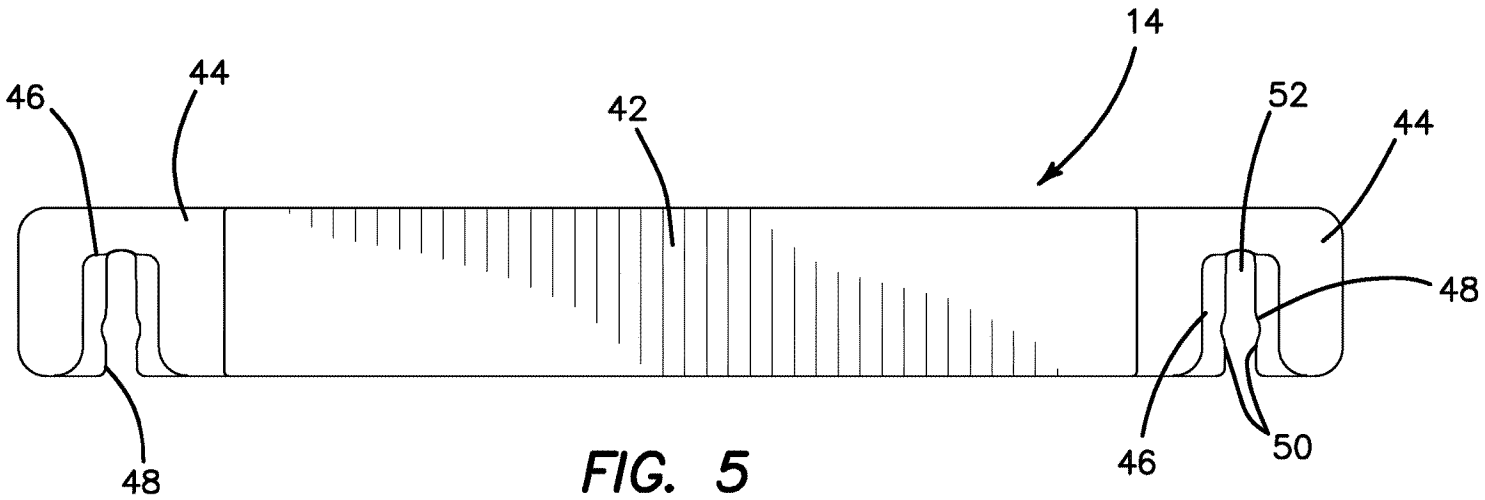
FIG. 5 is top down view of a connector component used to form the can dispenser seen in FIG. 1.
Figure 6:
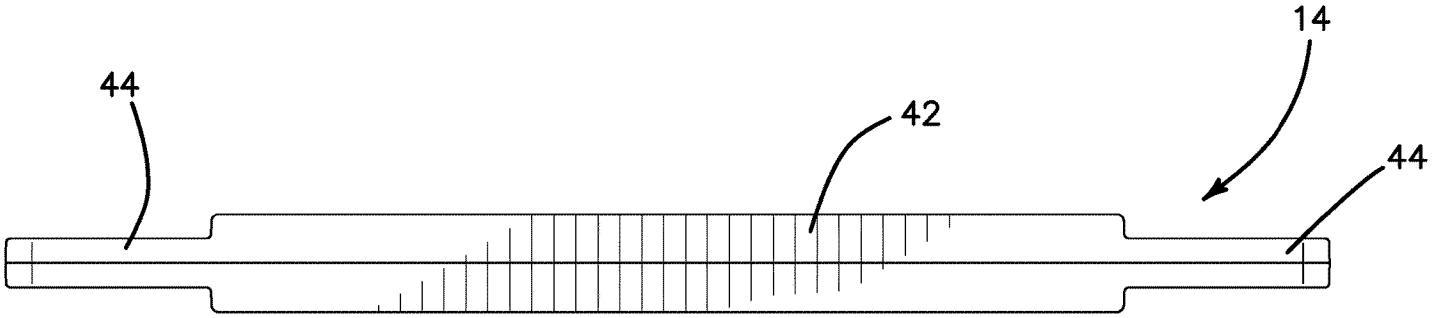
FIG. 6 is a side planar view of the connector seen in FIG. 5.

Greater detail of the connector or link 14 may be seen by turning to FIGS. 5 and 6. Each connector or link 14 comprises a substantially rectangular shaped body 42 with a coupling aperture or portion 44 disposed at either end of the body 42. As best seen in FIG. 6, each coupling portion 44 comprises a thinner or reduced cross-sectional thickness as compared to the body 42 of the connector 14. Defined in each coupling portion 44 is a substantially rectangular shaped protrusion slot 46. Disposed in turn within each protrusion slot 46 is a bifurcated fork element 48 which is sized and shaped to accommodate and form a friction fit with a recess 38, 40 of a protrusion 36 as is discussed in further detail below. As seen in FIG. 6, the fork element 48 comprises two adjacently disposed hooks or tines 50 that are angled towards each other so as to form a type of "funnel," reduced, necked down, or angled point of entry. Each tine 50 further comprises a barb or rounded portion at the end of the angled proximal surface. The connectors or links 14 cam be formed as any type of linkage with wedge, screw, frictional engagement coupling, or latches between the frames 12. In essence the connectors or links 14 can provide a removable frictional engagement to join the support frames 12.

In order to form a can dispenser 10 of the current invention, a plurality of connectors or links 14 are coupled to at least two separate support frames 12, 12' which are disposed in parallel with respect to each other in a substantially vertical orientation. Each of the connectors or links 14 comprise at least two ends which are each removably coupled to at least one of two support frames 12, 12.' Specifically, each connector or link 14 is coupled to a corresponding support frame 12, 12' through a connecting means which may include a camlock with a male cam disposed on the connector or link 14 and a female cam disposed on the support frame 12, 12.' Alternatively, the connector or link 14 may comprise male threaded screw while the support frame 12, 12' comprises a female threaded aperture. In yet another embodiment, each connector or link 14 is coupled to a support frame 12, 12' through a spring catch, specifically with a spring and latch mounted to the connector or link 14 and a corresponding female aperture defined in the support frame 12, 12.' Other coupling means including but not limited to latches, pawls, bolts, clamps, locks, catches, or pins or other equivalent means now known or later devised may also be used without departing from the original spirit and scope of the invention.

Figure 9:
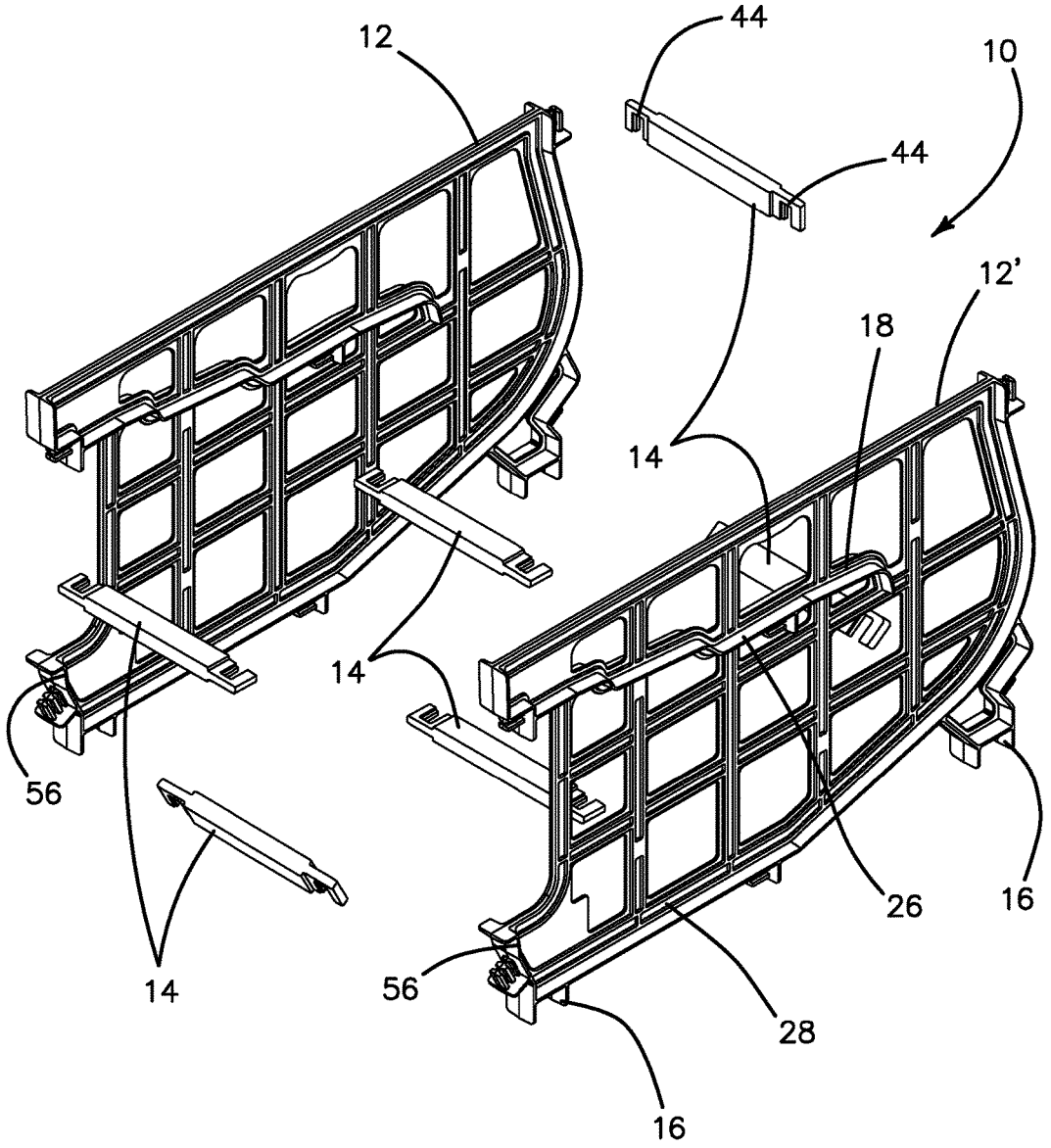
FIG. 9 is an exploded perspective view of the can dispenser seen in FIG. 1.

In a preferred embodiment, a connector or link 14 is coupled to a first support frame 12 by sliding the protrusion slot 46 disposed on either end of the connector or link 14 about one of the protrusions 36 of any of one of the connection points 34. More specifically, the fork element 48 of the protrusion slot 46 is pressed against the upper recess 38 of the protrusion 36 until the tines 50 make contact with the material disposed in the middle portion of the upper recess 38. The protrusion slot 46 and fork element 48 are continually pushed against the upper recess 38 until the portion of the protrusion 36 contained therein slides deeper into the fork element 48 past the barb elements and into a cavity 52 defined in the middle of the fork element 48. Because the entirety of the portion of the protrusion 36 within the upper recess 38 fits within the cavity 52, the barb elements of the tines 50 effectively keep the protrusion slot 46 coupled to the protrusion 36 and thus prevents any relative movement between the support frame 12 and the connector or link 14. This process is repeated for each connection point 34 disposed on the first support frame 12 so that each connection point 34 will ultimately have at least one corresponding connector or link 14 coupled to it with each connector or link 14 orientated in a perpendicular direction relative to the support frame 12 as best seen in FIG. 9. Once all the connectors 14 have been coupled to the support frame 12 at each of their respective ends, the process is repeated by coupling the opposing ends of the connectors 14 to a second frame 12'. Specifically, because the first and second frames 12, 12' are mirror images of each other, each protrusion slot 46 of each connector 14 is aligned with the upper recess 38 of a corresponding protrusion 36 disposed on the matching connection point 34 within the second frame 12'. Once aligned, each connector 14 is coupled to the second frame 12' by means of the fork element 48 and specific geometry of the upper recess 38 of the protrusion 36 in the same manner detailed above.

Figure 3:
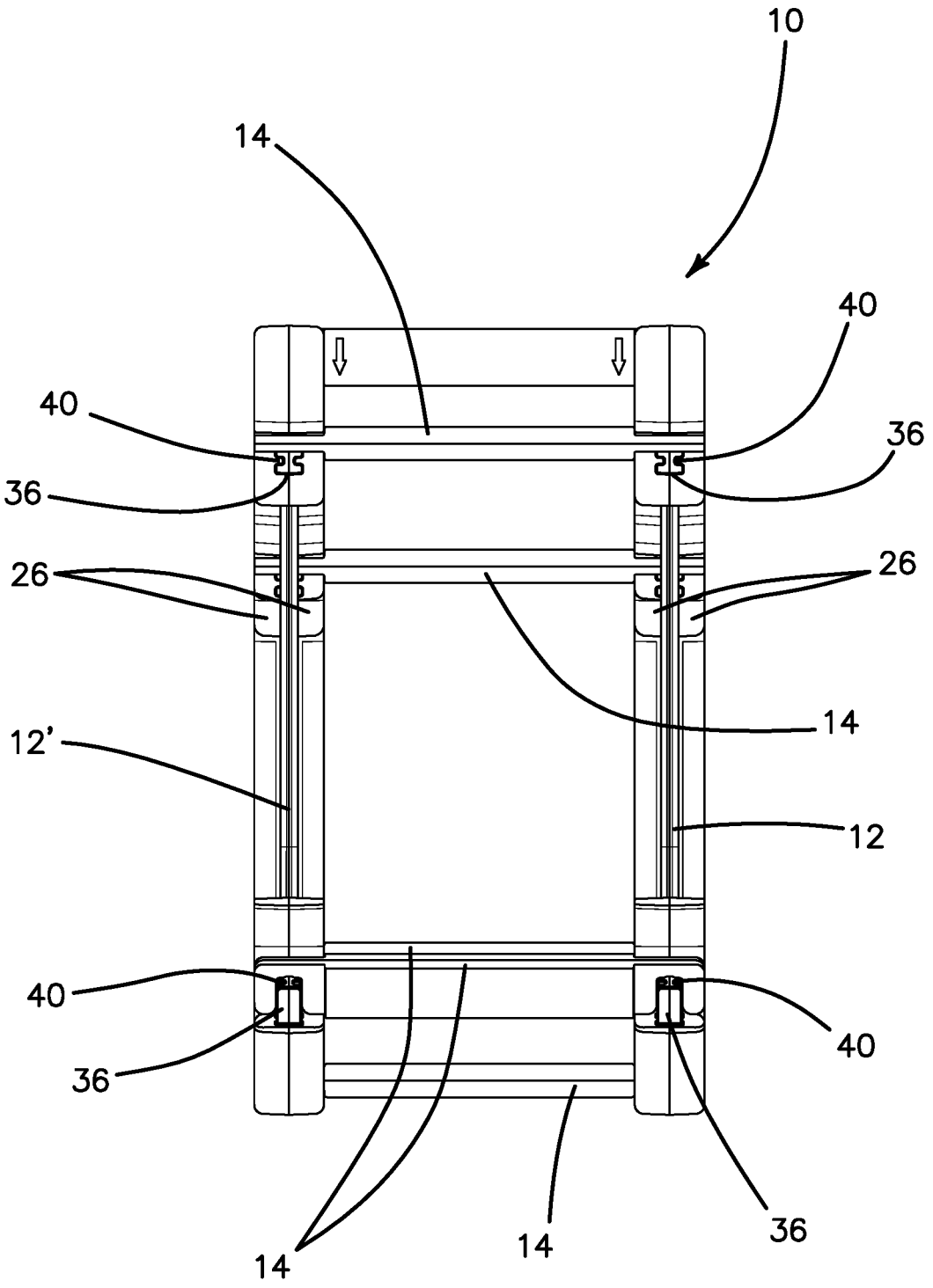
FIG. 3 is rear view of the can dispenser seen in FIG. 1
Figure 4:
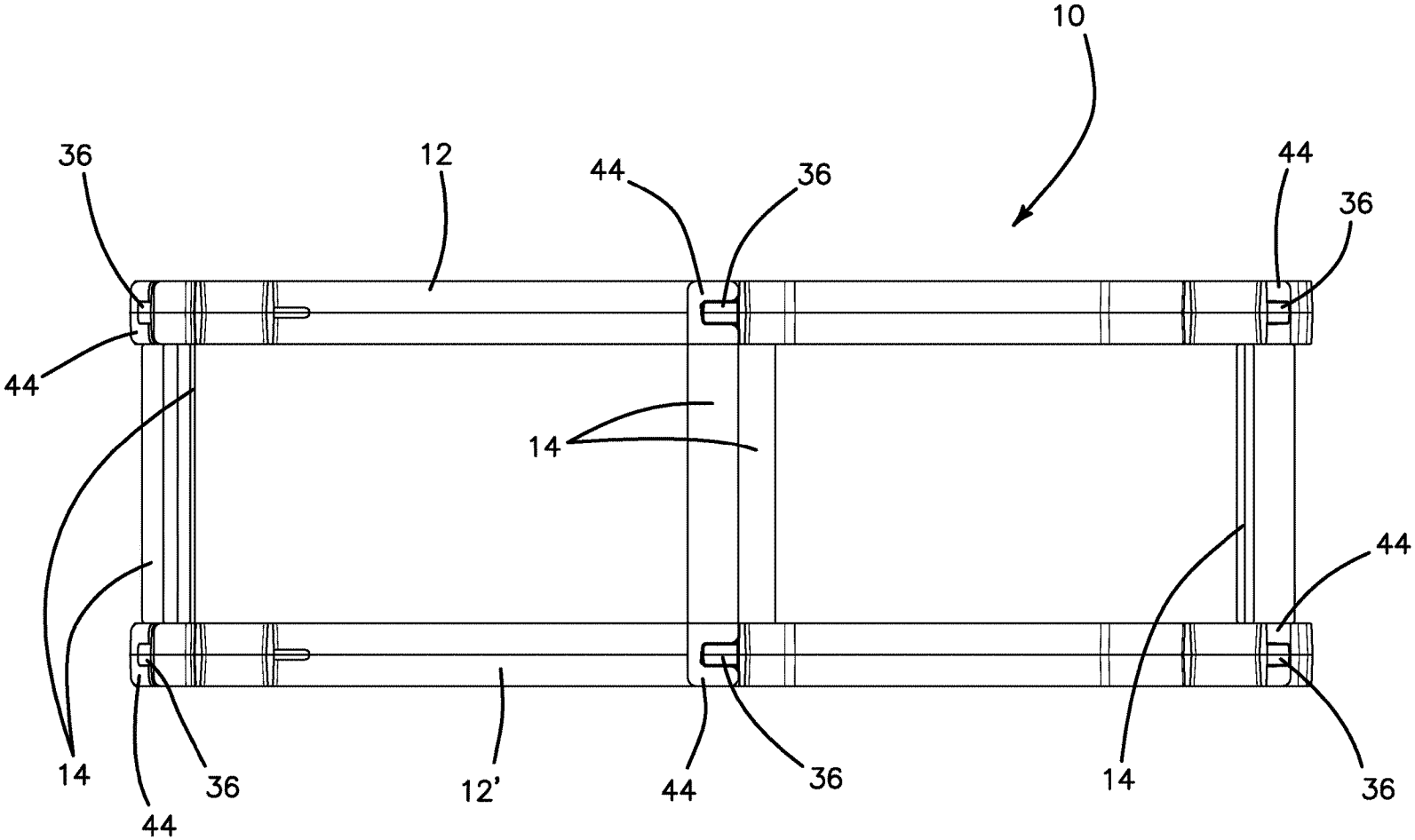
FIG. 4 is a bottom planar view of the can dispenser seen in FIG. 1.

After the plurality of connectors 14 have been coupled to both the first support frame 12 and the second support frame 12,' a housing is formed which forms the basic structure of the can dispenser 10 as seen in FIGS. 1, 3, and 4. FIGS. 3 and 4 specifically show the detail of the coupling of the connectors 14 to the frames 12, 12' with each connector 14 being orientated perpendicular relative to both the first and second frames 12, 12'. It can also be seen from FIGS. 3 and 4 that because each connector or link 14 coupled to the upper recess 38 of each protrusion 36, the lower recess 40 is left exposed. It can also be appreciated from FIGS. 1 and 3 that the completed can dispenser 10 is comprised of parallel support frames 12, 12' which allows for the symmetrical formation of upper and lower ramps 18, 28 disposed within the inner or center portion of the can dispenser 10 itself, thus creating a surface in which to hold and dispense cans therefrom.

Figure 7:
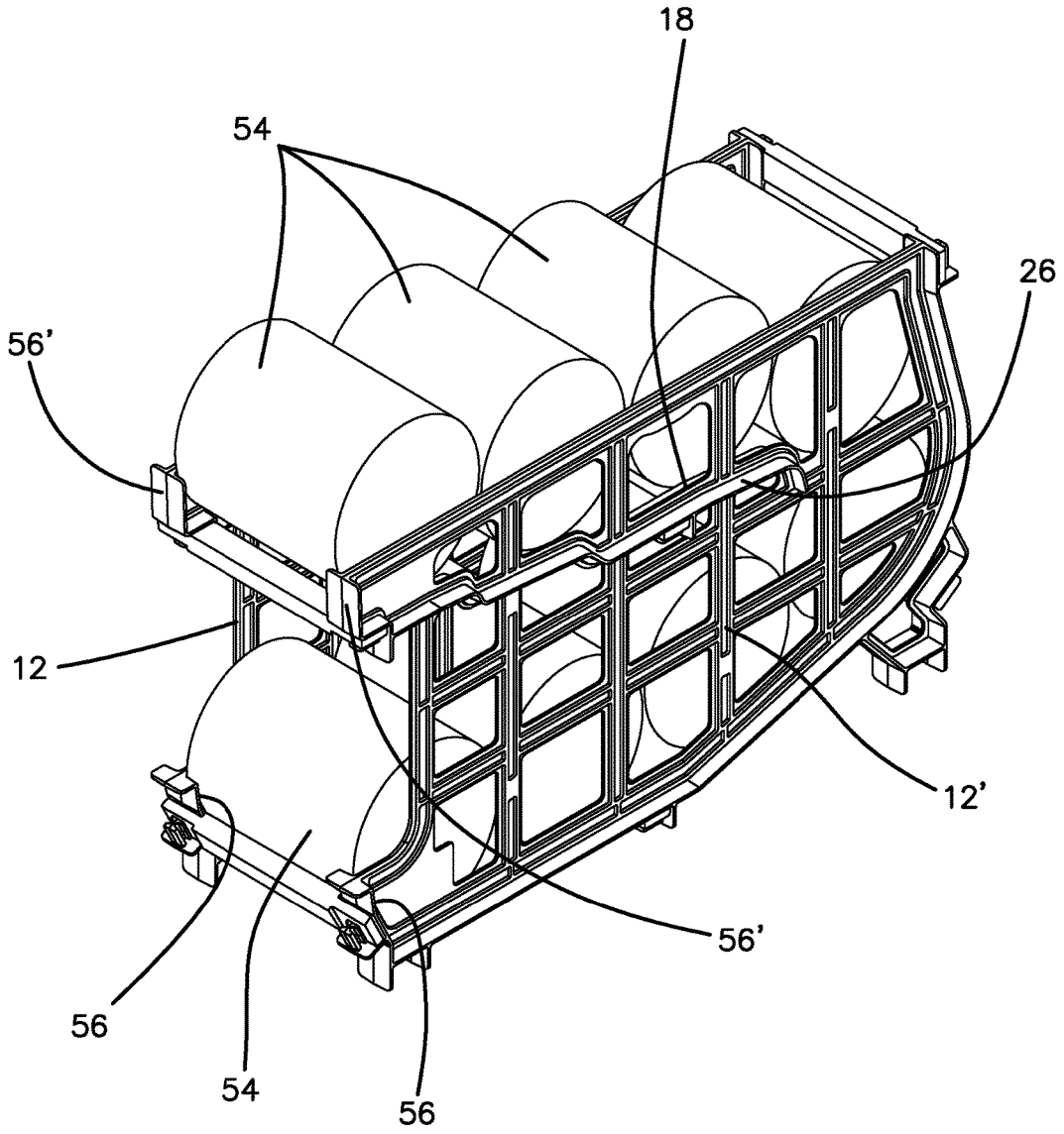
FIG. 7 is a perspective view of the can dispenser seen in FIG. 1 when a plurality of cans are inserted into the can dispenser.
Figure 8:
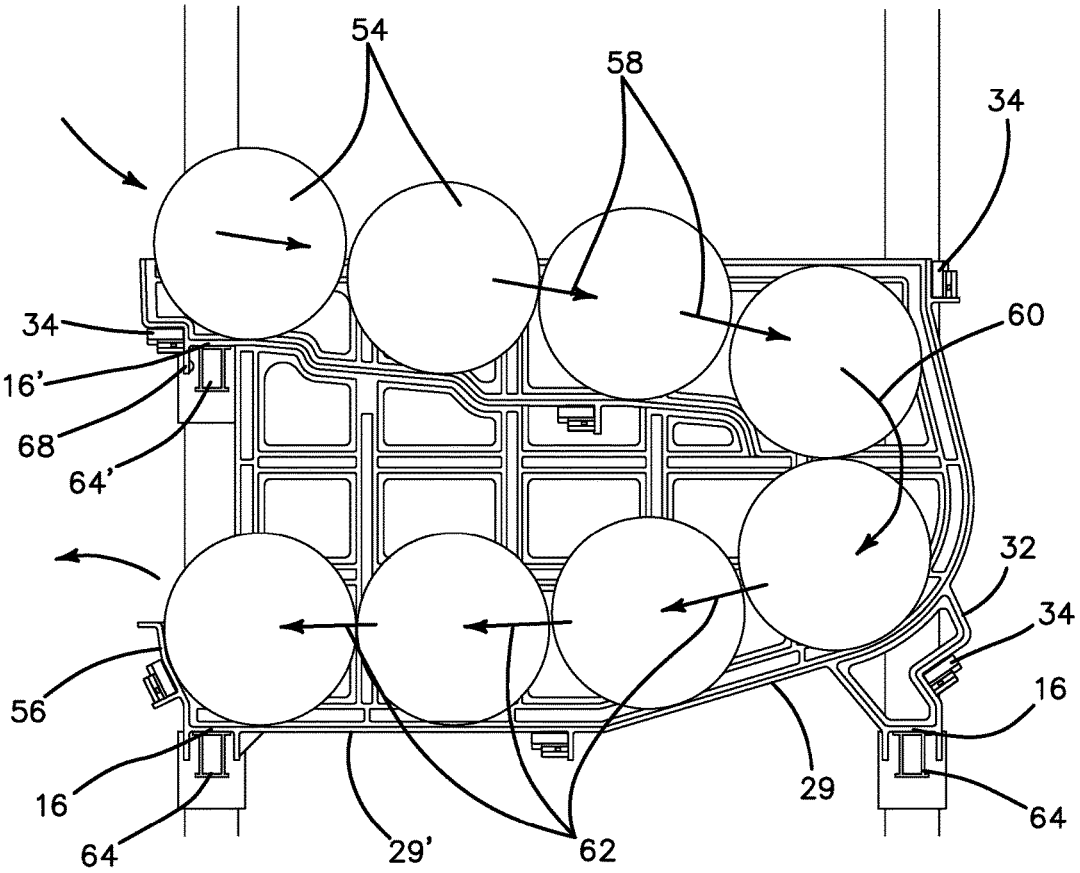
FIG. 8 is a side cross sectional view of the can dispenser seen in FIG. 1 when a plurality of cans are inserted into the can dispenser.

After the can dispenser 10 has been constructed, a plurality of cans 54 can be accommodated within the can dispenser 10 and dispensed therefrom as seen in FIGS. 7 and 8. A user loads a can 54 between the first and second frames 12, 12' on the upper ramp 18 of each of the frames 12, 12'. Because the upper ramp 18 is oriented downwardly as seen in FIG. 8, the can 54 rolls down the upper ramp 18 and its associated rail due to gravitational force along each respective flange 26 towards the rear of the can dispenser 10 and away from the user in the direction indicated by arrow 58. The can 54 continues to roll down the upper ramp 18 and then falls off of the upper ramp 18 and onto the lower ramp 28, specifically the angled inclined portion 29 of the lower ramp 28. The can 54 then reverses direction as depicted by arrow 60 and then continues down the lower ramp 28 under its own momentum across the flat portion 29' of the lower ramp 28 back towards the user and the front of the can dispenser 10 as indicated by arrows 62 until making contact with a stop 56 disposed on each frame 12, 12'. A subsequent can 54 may then loaded into the can dispenser 10 in the same fashion described above, the subsequent can 54 coming to rest against the previous can 54 disposed at rest on the lower ramp 28. This process may be repeated until the can dispenser 10 is completely filled with cans 54 on the both the upper and lower ramps 18, 28 as is seen in FIG. 7. It can be appreciated that every time a can 54 disposed in the lower ramp 28 against the stops 56 is removed, the next adjacent can 54 will roll down and take its place. This action will create a domino effect with each subsequent can 54 disposed in the can dispenser 10 to roll forward and take the adjacent can's 54 position and thus create a free or open spot at the front end of the upper ramp 18. The user may then insert another can 10 onto the upper ramp 18, or alternatively wait until the can dispenser 10 is fully or partially depleted before inserting more cans 54. It should be noted that while FIGS. 7 and 8 show eight number 10 sized cans 54 being stored within the can dispenser 10 this is meant to be for illustrative purposes only. Fewer or additional cans of different or varying sizes may also be used without departing from the original spirit and scope of the invention.

FIG. 8 also depicts how the can dispenser 10 may be placed on a shelf or shelving unit. Preferably, the can dispenser 10 may be placed on a pair of parallel, horizontal traverses of the shelving unit itself, for example the pultruded traverses of the shelving unit as disclosed in U.S. Pat. Nos. 8,376,156 and 8,376,157 which are incorporated by reference in their entirety herein. Specifically, each of the plurality of lower shelf supports 16 comprise a pair of shelf fixture or brackets 66 as best seen in FIG. 1. Each pair of shelf brackets 66 are sufficiently sized and spaced apart from each other to straddle or encompass the width of a horizontal traverse of a shelving unit. In one particular embodiment, the can dispenser 10 is placed on a pair of horizontal traverses 64 of a shelving unit by disposing each of the lower shelf supports 16 directly over a corresponding traverse 64 and then lowering the downward facing, U-shaped shelf brackets 66 of the lower rail feet 16 on to each traverse 64, thus encompassing the width of the traverse 64 entirely between each of the shelf brackets 66. A plurality of cans 54 may be loaded into the can dispenser 10 and/or dispensed therefrom as detailed above.

In an alternative embodiment, the can dispenser 10 may be supported by at least three traverses 64 as seen in FIG. 8. In this embodiment, an upper shelf support 16' is disposed directly beneath the upper ramp 18 of each of the support frames 12, 12' so that when the can dispenser 10 is placed on the traverses 64 as detailed above, a third traverse 64' is inserted into or accommodated by an upper or secondary shelf bracket 68 on the upper shelf support 16' at the same time. In this embodiment it can be seen that the weight of the can dispenser 10 and the cans 54 contained therein would be evenly distributed across three traverses 64, 64' and thus make the can dispenser 10 more stable and less likely to fall from the shelving unit.

Figure 10A:
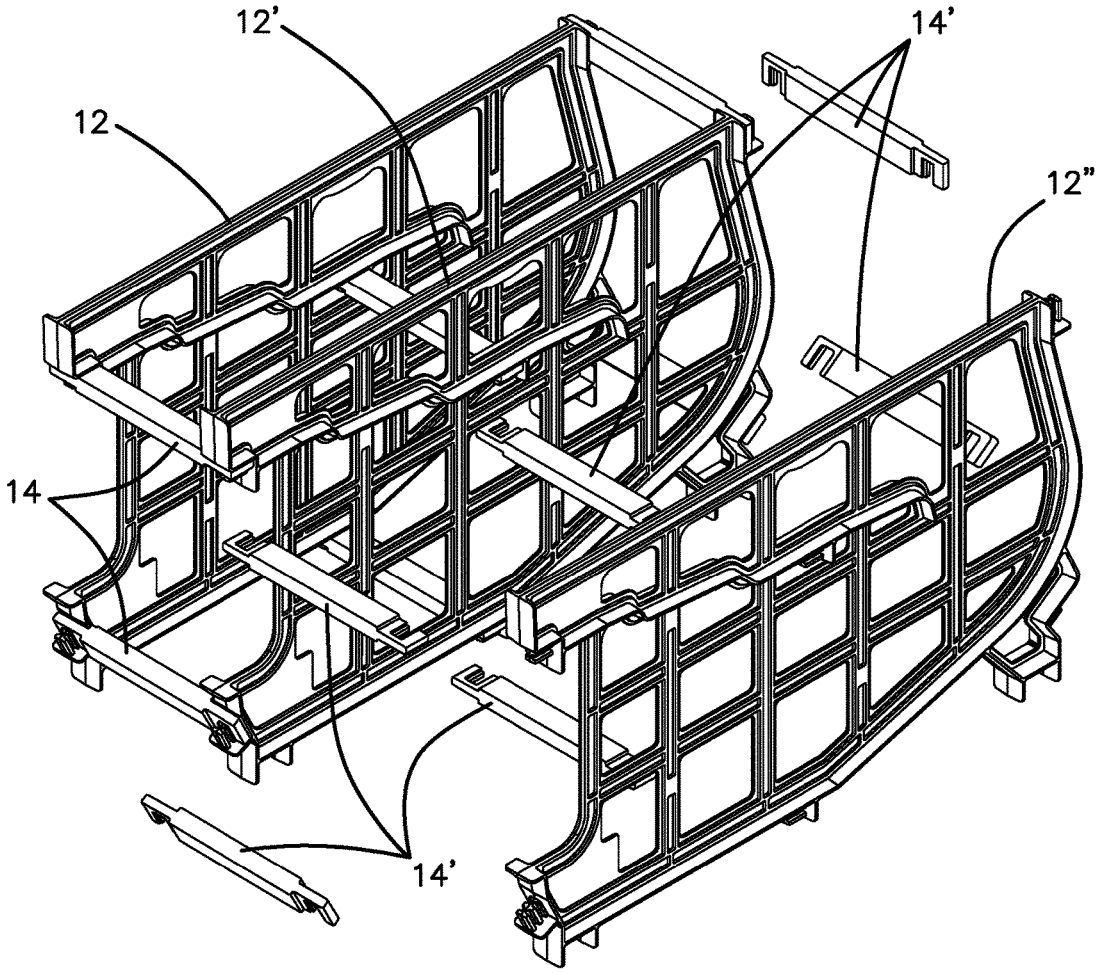
FIG. 10A is a partially exploded perspective view of the components used to form a second can dispenser which is coupled to the first can dispenser seen in FIG. 1.
Figure 10B:
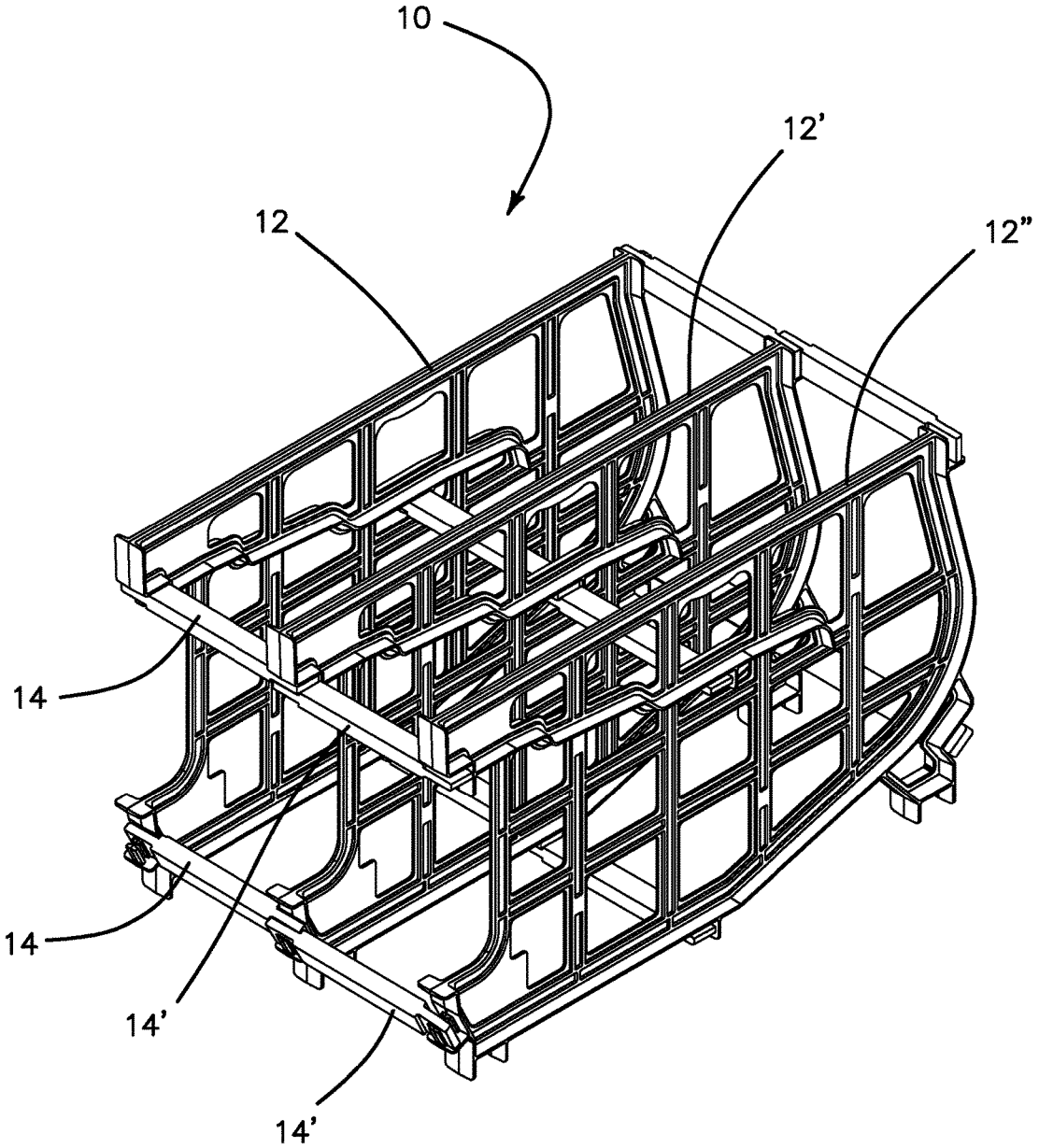
FIG. 10B is a perspective view of the second can dispenser after being coupled to the first can dispenser seen in FIG. 1.

In a further embodiment seen in FIGS. 10A and 10B, the can dispenser 10 may be extended or expanded by adding on to the existing frame of the can dispenser 10. As seen in FIG. 10A, a second plurality of connectors or links 14' are coupled to the second frame 12'. More specifically, each of the second plurality of connectors or links 14' are coupled to the available lower recess 40 of each protrusion 36 disposed on the second frame 12'. As is detailed above with the formation of the first embodiment of the can dispenser 10, after each of the second plurality of connectors or links 14' have been coupled to the second frame 12' at each of their respective ends, the process is repeated by coupling the opposing ends of the connectors or links 14' to a third support frame 12". Specifically, because the first, second, and third support frames 12, 12', 12" are mirror images of each other, each protrusion slot 46 of each connector or link 14' is aligned with the lower recess 40 of a corresponding protrusion 36 that is disposed on the matching connection point 34 within the third frame 12". Once aligned, each connector 14' is coupled to the third frame 12" by means of the fork element 48 and specific geometry of the lower recess 40 of the protrusion 36 in the same manner detailed above. With the second plurality of connectors or links 14' connected between the second and third support frames 12', 12", an extended or expanded can dispenser 10' is formed as is seen in FIG. 10B. In this configuration, the can dispenser 10' may accommodate and dispense twice as many cans 54 as the first embodiment of the can dispenser 10 seen in FIG. 1, while still maximizing the shelf space available to the user.

Figure 11:
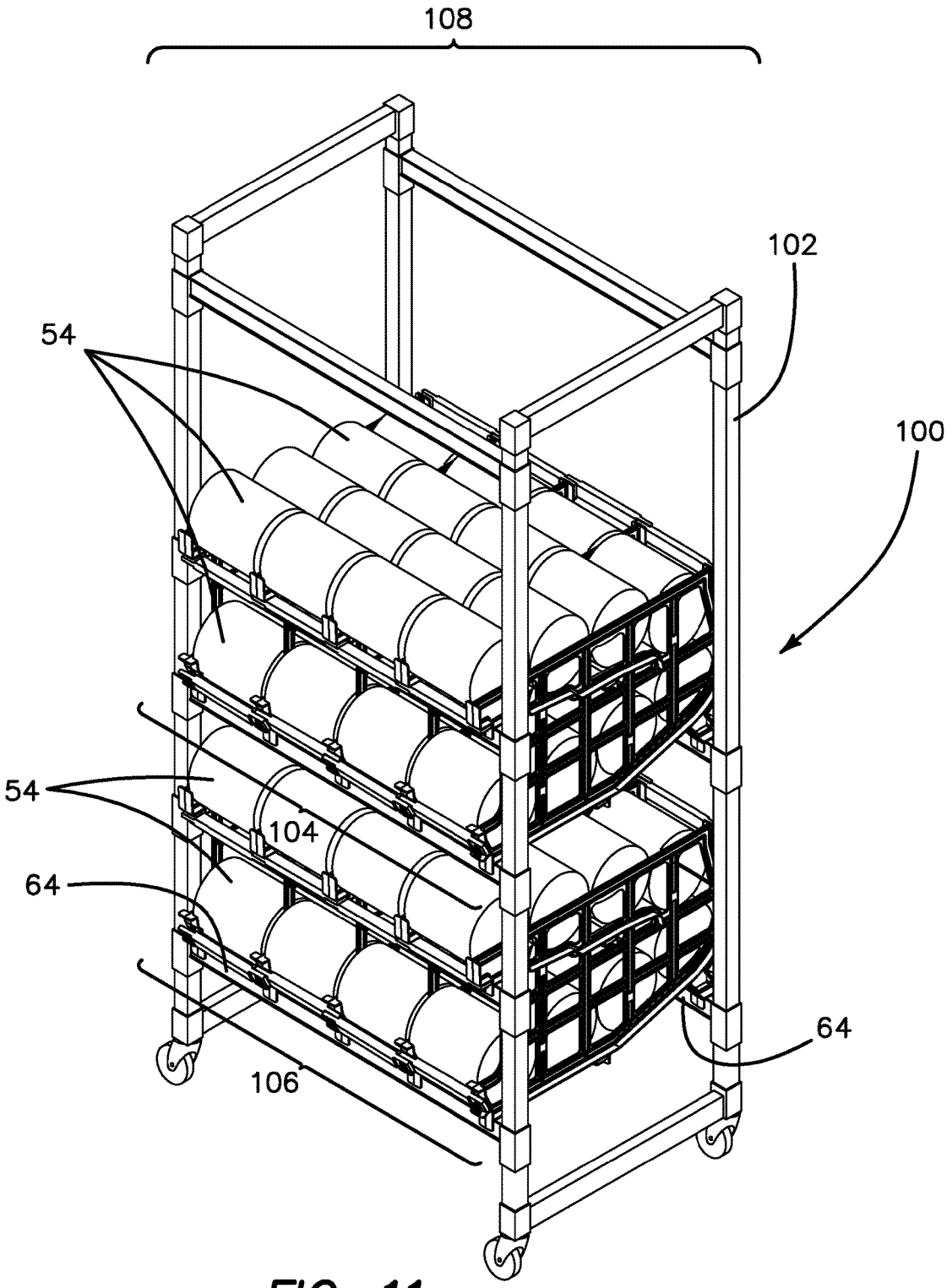
FIG. 11 is a perspective view of a shelving unit comprising a plurality of can dispensers disposed therein with a corresponding plurality of cans disposed in each.

The process of coupling additional pluralities of connectors or links 14, 14' to additional support frames 12, 12', 12" and expanding the can dispenser 10, 10' may be repeated indefinitely for as long as the user desires or for as much shelf space as may be available with each subsequent plurality of connectors being coupled to each subsequently added support frame at an alternating position within the protrusion 36 of each connection point 34. As detailed above, the first plurality of connectors or links 14 which are used to couple the first and second support frames 12, 12' together to form the can dispenser 10 seen in FIG. 1 are coupled to each respective upper recess 38 of each connection point 34. In turn, the second plurality of connectors 14' which are used to couple the second and third support frames 12', 12" together to form the expanded can dispenser 10' seen in FIG. 10B are coupled to each respective lower recess 40 of each connection point 34. If the can dispenser 10' is expanded again, a fourth support frame 12, 12', 12" may be added by coupling a new plurality of connectors or links 14, 14' to the third frame 12" at each corresponding upper recess 38 and so on. This pattern of coupling each connector to the upper and then lower recess 38, 40 of each connection point 34 would then be repeated every time the can dispenser 10 is expanded and an additional support frame is added. In this manner, a can dispenser system 100 may be formed as best seen in FIG. 11. In this embodiment, the system 100 may be disposed in a shelving unit 108 comprised of a plurality of vertical supports, columns, or uprights 102 and a plurality of horizontal beams or traverses 64. The system 100 may comprise a first dispensing platform or shelf 104 and a second dispensing platform or shelf 106, each of the first and second dispensing shelves 104, 106 in turn comprising a plurality of can dispensers 10 joined together as discussed above. As similarly disclosed above, the plurality of can dispensers 10 used to form both the first and second dispensing shelves 104, 106 are disposed directly on the traverses 64 of the shelving unit 108 via the plurality of lower shelf supports 16 and upper shelf supports 16' and their respective shelf brackets 66, 68 disposed on each of the frames within each dispenser shelf 104, 106. With the can dispensing system 100 fully formed, a user may store and dispense a large number of cans 54 in a relatively small storage volume. While FIG. 11 shows a can dispenser system 100 comprised of two dispensing shelves 104, 106, with each respective dispensing shelf 104, 106 in turn comprising four can dispensers 10 coupled or linked together, this is meant to be for illustrative purposes only. It is to be expressly understood that because the can dispenser system 100 may be expanded or contracted according to a user's specific requirements, fewer or additional can dispensers or can dispenser shelves other than what is shown may be present without departing from the original spirit and scope of the invention.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An apparatus for accommodating and dispensing a plurality of cans comprising:

a first support frame;

a second support frame disposed substantially parallel to the first support frame; and a plurality of connectors removably coupled to the first support frame and the second support frame, wherein the plurality of connectors are angularly oriented relative to the first support frame and second support frame, wherein the first support frame and the second support frame each comprise an upper ramp, a lower ramp, and a top portion which forms an upper longitudinal edge of the support frame, wherein at least one end of the lower ramp is integrally formed with the top portion and defines a gap disposed between the upper ramp and lower ramp, the gap configured to accommodate at least one of the plurality of cans therethrough, and wherein the upper ramp comprises an upper shelf support disposed on its bottom surface, the upper shelf support configured to engage with a traverse of a shelving unit, wherein the upper shelf support disposed on the upper ramp of the first and second support frames comprises an upper shelf bracket configured to accommodate a traverse of the shelving unit.

2. The apparatus of claim 1 wherein the first support frame and second support frame each comprise a plurality of lower shelf supports coupled to the lower ramp.

3. The apparatus of claim 1 wherein the plurality of connectors are removably coupled to the first support frame and the second support frame via a corresponding plurality of connection points disposed on the first support frame and the second support frame, each of the plurality of connection points further comprising a cylindrical protrusion.

4. The apparatus of claim 3 wherein the cylindrical protrusion of each of the plurality of connection points comprises:

a longitudinal axis;

an upper recess defined at a distal end of the longitudinal axis of the cylindrical protrusion; and a lower recess defined at a proximal end the longitudinal axis of the cylindrical protrusion, wherein the upper recess is configured to accommodate a first connector of the plurality of connectors, and wherein the lower recess is configured to accommodate a second connector of the plurality of connectors.

5. The apparatus of claim 1 wherein each of the plurality of connectors comprise a body and a coupling portion at either end of the body, each coupling portion having a reduced cross sectional thickness relative to the body.

6. The apparatus of claim 5 wherein each coupling portion of each connector further comprises a protrusion slot defined therein, each protrusion slot comprising a bifurcated fork element disposed on a pair of inside surfaces of the protrusion slot.

7. The apparatus of claim 1 wherein the lower ramp of the first support frame and the second support frame comprises at least one portion oriented at an incline relative to a remaining portion of the lower ramp.

8. The apparatus of claim 1 wherein the first support frame and the second support frame each comprise a stop coupled to the lower ramp of the first support frame and second support frame.

9. The apparatus of claim 1 wherein the upper ramp and the lower ramp of each respective first and second support frame comprises a dual sided flange extending substantially outward from each lateral side of the first and second support frame.

10. The apparatus of claim 2 wherein each of the plurality of lower shelf supports coupled to the lower ramp of the first and second support frames comprise a pair of shelf brackets configured to accommodate a traverse of a shelving unit.

11. The apparatus of claim 1 wherein the upper ramp comprises a smaller longitudinal length than the lower ramp and wherein the upper ramp is downwardly angled relative to the lower ramp.

12. The apparatus of claim 11 wherein the upper ramp comprises:

a first graduated level;

a second graduated level;

a first sloping portion interconnecting the first graduated level to the second graduated level;

a third graduated level; and a second sloping portion interconnecting the second graduated level to the third graduated level.

13. An apparatus for accommodating and dispensing a plurality of cans comprising:

a first support frame;

a second support frame disposed substantially parallel to the first support frame; and a plurality of connectors removably coupled to the first support frame and the second support frame via a corresponding plurality of connection points disposed on the first support frame and the second support frame, each of the plurality of connection points further comprising a cylindrical protrusion comprising a longitudinal axis, an upper recess defined at a distal end of the longitudinal axis of the cylindrical protrusion, and a lower recess defined at a proximal end of the longitudinal axis of the cylindrical protrusion, wherein the upper recess is configured to accommodate a first connector of the plurality of connectors, and wherein the lower recess is configured to accommodate a second connector of the plurality of connectors, wherein the first support frame and the second support frame each comprise an upper ramp and a lower ramp, and wherein the first support frame and second support frame each comprise a first shelf support and a second shelf support disposed on a bottom surface of the lower ramp and an upper shelf support disposed on a bottom surface of the upper ramp, the upper shelf support being configured to engage with a traverse of a shelving unit.

14. The apparatus of claim 13 further comprising a frame extension disposed between the lower ramp and the second lower shelf support disposed on the bottom surface of the lower ramp, the frame extension configured to maintain the second shelf support at the same vertical position of the first shelf support.

* * * * *